US009297324B2

(12) United States Patent
Yahata et al.

(10) Patent No.: US 9,297,324 B2
(45) Date of Patent: Mar. 29, 2016

(54) DETECTION APPARATUS

(75) Inventors: Shigeto Yahata, Obu (JP); Tomohiro Ueno, Nagoya (JP)

(73) Assignee: DENSO CORPORATION, Kariya (JP)

( * ) Notice: Subject to any disclaimer, the term of this patent is extended or adjusted under 35 U.S.C. 154(b) by 570 days.

(21) Appl. No.: 13/357,826

(22) Filed: Jan. 25, 2012

(65) Prior Publication Data

US 2012/0186230 A1 Jul. 26, 2012

(30) Foreign Application Priority Data

Jan. 25, 2011 (JP) ..... 2011-012689

(51) Int. Cl.
*F01N 3/00* (2006.01)
*F02D 41/14* (2006.01)

(52) U.S. Cl.
CPC ..... *F02D 41/1466* (2013.01); *F01N 2560/05* (2013.01); *F01N 2560/20* (2013.01); *F02D 41/1494* (2013.01)

(58) Field of Classification Search
CPC ..... F02D 41/1466; F02D 41/1494; F01N 2560/05; F01N 2560/20
USPC ..... 60/274–299, 311; 55/282.3, 522, 523, 55/524; 73/114.31
See application file for complete search history.

(56) References Cited

U.S. PATENT DOCUMENTS 4,656,832 A 4/1987 Yukihisa et al.
6,973,778 B2 12/2005 Kondou et al.
7,146,805 B2 12/2006 Otake et al.
7,174,706 B2 * 2/2007 Kuboshima et al. ..... 60/295
7,243,491 B2 7/2007 Okugawa et al.
8,151,559 B2 4/2012 Okugawa et al.
2004/0144087 A1 * 7/2004 Kondou et al. ..... 60/295
2004/0226288 A1 * 11/2004 Okugawa et al. ..... 60/295
2005/0056009 A1 * 3/2005 Otake et al. ..... 60/311
2008/0105567 A1 * 5/2008 Okayama et al. ..... 205/775

(Continued)

FOREIGN PATENT DOCUMENTS

JP S59-060018 4/1984
JP S62-035252 2/1987

(Continued)

OTHER PUBLICATIONS

Office Action (2 pages) dated Jan. 31, 2013, issued in corresponding Japanese Application No. 2011-012689 and English translation (3 pages).

*Primary Examiner* — Jesse Bogue
*Assistant Examiner* — Kelsey Stanek
(74) *Attorney, Agent, or Firm* — Nixon & Vanderhye P.C.

(57) ABSTRACT

A detection apparatus includes a detection unit, a control unit, a first setting unit, and a second setting unit. The detection unit is disposed in an exhaust path through which an exhaust gas flows, and detects a correlation value correlated with an amount of particulate matter (PM) attaching to an attachment element. The control unit controls a temperature of the attachment element to follow a target temperature while a regeneration process is performed to heat the attachment element so as to burn PM. The first setting unit sets the target temperature to be lower, as the amount of PM becomes larger. The second setting unit sets a completion timing of the regeneration process so that a period of the regeneration process becomes longer, as the amount of PM becomes larger or a temperature of the attachment element becomes lower while the regeneration process is performed.

6 Claims, 13 Drawing Sheets

(56) References Cited

U.S. PATENT DOCUMENTS

| | | | | |
|---|---|---|---|---|
| 2010/0312488 | A1* | 12/2010 | Diehl et al. | 702/23 |
| 2011/0094210 | A1* | 4/2011 | Suzuki et al. | 60/295 |

FOREIGN PATENT DOCUMENTS

| | | | |
|---|---|---|---|
| JP | 7-034858 | | 2/1995 |
| JP | 7034858 | * | 2/1995 |
| JP | 2005-090359 | | 4/2005 |
| JP | 2005-240672 | | 9/2005 |
| JP | 2006-266961 | | 10/2006 |
| JP | 2006266961 | * | 10/2006 |
| JP | 2009-002308 | | 1/2009 |
| JP | 2009-144512 | | 7/2009 |
| JP | 2009-293466 | | 12/2009 |
| JP | 2010-151553 | | 7/2010 |

* cited by examiner

CROSS SECTION ALONG LINE A-A

DETECTION APPARATUS

CROSS-REFERENCE TO RELATED APPLICATION

This application is based on and claims the benefit of priority from earlier Japanese Patent Application No. 2011-012689 filed Jan. 25, 2011, the description of which is incorporated herein by reference.

BACKGROUND OF THE INVENTION

1. Technical Field of the Invention

The present invention relates to a detection apparatus, and in particular to a detection apparatus that detects an amount of particulate matter in an exhaust gas that flows through the exhaust path of an internal combustion engine.

2. Related Art

Recently, internal combustion engines are required to have superior exhaust purification performance. In diesel engines, in particular, removal of so-called exhaust particulates (particulate matter (PM)), such as black smoke, exhausted from the engines is of increasing importance. In order to remove PM, diesel engines are most commonly equipped with a diesel particulate filter (DPF) in the middle of the exhaust pipe.

PM sensors are one of the means for detecting the amount of PM in an exhaust gas. For example, using a detection value derived from a PM sensor disposed downstream of a DPF, a failure of the DPF, if any, can be detected. Further, when such a PM sensor is disposed upstream of a DPF, the amount of PM accumulated in the DPF can be estimated from a detection value derived from the PM sensor. For example, JP-A-559-060018 discloses a system for estimating the amount of PM accumulated in a DPF by disposing a PM sensor in an exhaust pipe.

As shown in FIG. 18, a PM sensor 5 of a typical structure includes an insulator 50, a pair of electrodes 51 and 52, and a power supply 54. When the PM sensor 5 is disposed in an exhaust pipe through which PM flows, PM is deposited on the insulator 50. Since PM is electrically conductive, accumulation of PM between the electrodes 51 and 52 to the extent of connecting therebetween will create an electrically conductive state across the electrodes. Accordingly, when voltage is applied by the power supply 54 across the electrodes 51 and 52, current passes across the electrodes 51 and 52. As more PM is accumulated between the electrodes 51 and 52, more current passes across the electrodes. Therefore, the amount of PM accumulated on the insulator, and further, the amount of PM in the exhaust pipe is detected (estimated) based on the current passing across the electrodes.

The use of the PM sensor is required to burn PM attaching to the PM sensor so as to regenerate the PM sensor each time an amount of PM attached (deposited) to the PM sensor (its insulator) is judged to be too large. FIG. 17 shows an example of this case.

As shown in FIG. 17, after a completion of a regeneration process of the PM sensor, an amount of PM attaching to the insulator increases from zero state with time, but an output value of the PM sensor remains in a zero state until a positive electrode and a negative electrode (corresponding to the electrodes 51 and 52 in FIG. 18) are electrically connected via PM deposited. At one point, once the positive electrode and the negative electrode are electrically connected, the output value of the PM sensor starts to increase. If the output value of the PM sensor exceeds a predetermined threshold level, the regeneration process is performed. The above processes are repeated during operation of an engine.

In the regeneration of the PM sensor, if a regeneration period is too short, a part of PM may remain after burning to thereby reduce accuracy of detecting the amount of PM. On the other hand, for example, if the regeneration period is too long, a failure of the DPF cannot be detected during the regeneration of the PM sensor. Therefore, an unnecessarily long length of the regeneration period is required to be avoided.

A temperature (electrode temperature) needed to burn PM during the regeneration of the PM sensor is controlled to follow a set target temperature. If the target temperature is too high, PM attaching to the PM sensor rapidly burns and the PM sensor may be damaged. In contrast, if the target temperature is too low, it takes a long time to burn PM and then a long regeneration period of the PM sensor is required. This is not desirable. Therefore, the target temperature is required to be properly set. In the related art, above-mentioned situations, where the length of the regeneration period and the target temperature are required to be properly set during the regeneration of the PM sensor, are not recognized as problem to be solved.

SUMMARY

The present disclosure has been made in light of the problem set forth above, and provides, in a detection apparatus that detects an amount of particulate matter (or a correlation amount correlated with the amount of particulate matter) by an attachment of particulate matter emitted by an internal combustion engine, a detection apparatus which is able to properly set a length of a regeneration period and a target temperature in a regeneration process to burn particulate matter attached to the detection apparatus.

According to an exemplary aspect of the present disclosure, there is provided a detection apparatus, comprising: a detection unit that is disposed in an exhaust path of an internal combustion engine through which an exhaust gas flows, which includes an attachment element to which particulate matter in the exhaust gas attaches, and detects a correlation value that is correlated with an amount of particulate matter which is attached to the attachment element; a control unit that controls a temperature of the attachment element to follow a target temperature while a regeneration process is performed to heat the attachment element so as to burn particulate matter which attaches to the attachment element; a first setting unit that sets the target temperature to be lower, as an amount of particulate matter which attaches to the attachment element becomes larger; and a second setting unit that sets a completion timing of the regeneration process in such a manner that a period of the regeneration process becomes longer, as an amount of particulate matter which attaches to the attachment element becomes larger or a temperature of the attachment element becomes lower while the regeneration process is performed.

According to this, the detection apparatus that is disposed in the exhaust path of the internal combustion engine through which the exhaust gas flows detects a correlation value that is correlated with an amount of particulate matter which attaches to the attachment element. The target temperature, in the regeneration process in which the attachment element is heated, is set to become lower as the amount of particulate matter which attaches to the attachment element becomes larger. If the attached amount of particulate matter is large, the target temperature is set to become low, thereby being able to avoid the excess burning. If the attached amount of particulate matter is small, the target temperature is set to become high and then particulate matter is quickly burned, thereby being able to avoid the unnecessarily long length of the regeneration period. Further, as the amount of particulate matter which attaches to the attachment element becomes larger or the temperature of the attachment element becomes lower while the regeneration process is performed, the period of the regeneration process becomes longer. If the attached amount of particulate matter is large or the temperature of the attachment element is low, the length of the regeneration period is long, thereby being able to reduce a situation where a part of particulate matter remains after burning. If the attached amount of particulate matter is small or the temperature of the attachment element is high, the length of the regeneration period is short, thereby being able to avoid the unnecessarily long length of the regeneration period. Therefore, the target temperature and the length of the regeneration period are properly set, thereby being able to realize a detection apparatus that can be regenerated with avoiding the excess burning, the unnecessarily long length of the regeneration period, and the situation where a part of particulate matter remains after burning.

The first setting unit may include a third setting unit that sets the target temperature to be lower, as the correlation value, which is detected by the detection unit before a start of the regeneration process, becomes larger.

According to this, as the correlation value before the start of the regeneration process becomes larger (i.e., the attached amount of particulate matter is large), the target temperature becomes lower. Due to this, before the start of the regeneration process, the target temperature can be set so that, if the attached amount of particulate matter is large, the target temperature is low, thereby being able to avoid the excess burning, and, if the attached amount is small, the target temperature is high, thereby being able to avoid the unnecessarily long length of the regeneration period. Therefore, the target temperature and the length of the regeneration period are properly set, thereby being able to realize a detection apparatus that can be regenerated, avoiding excess PM burning, unnecessarily long regeneration periods, and PM remaining after PM sensor regeneration.

The detection apparatus may further comprise a calculation unit that calculates an attached amount of particulate matter which attaches to the attachment element while the regeneration process is performed. The first setting unit may include a fourth setting unit that sets the target temperature to be lower, as the attached amount of particulate matter calculated by the calculation unit becomes larger.

According to this, the attached amount of particulate matter, which attaches to the attachment element while the regeneration process is performed, is calculated, and, as the calculated value of the attached amount becomes larger, the target temperature is set to become lower. Due to this, while the regeneration process is performed, the target temperature can be set at any time so that, if the attached amount of particulate matter is large, the target temperature is low, thereby being able to avoid the excess burning, and, if the attached amount is small, the target temperature is high, thereby being able to avoid the unnecessarily long length of the regeneration period. Therefore, the target temperature and the length of the regeneration period are properly set at any time while the regeneration process is performed, thereby being able to realize a detection apparatus that can be regenerated, avoiding excess PM burning, unnecessarily long regeneration periods, and PM remaining after PM sensor regeneration.

The second setting unit may include a fifth setting unit that sets the completion timing of the regeneration process so that the period of the regeneration process becomes longer, as the correlation value, which is detected by the detection unit before a start of the regeneration process, becomes larger.

According to this, as the correlation value before the start of the regeneration process becomes larger (i.e., the attached amount of particulate matter is large), the regeneration period becomes shorter. Due to this, before the start of the regeneration process, the length of the regeneration period can be set so that, if the attached amount of particulate matter is large, the length of the regeneration period is long, thereby being able to avoid the excess burning, and, if the attached amount is small, the length of the regeneration period is short, thereby being able to avoid the unnecessarily long length of the regeneration period. Therefore, the target temperature and the length of the regeneration period are properly set, thereby being able to realize a detection apparatus that can be regenerated, avoiding excess PM burning, unnecessarily long regeneration periods, and PM remaining after PM sensor regeneration.

The second setting unit may include a sixth setting unit that sets the completion timing of the regeneration process so that the period of the regeneration process becomes longer, as the temperature of the attachment element becomes lower while the regeneration process is performed.

According to this, as the temperature of the attachment element becomes lower, while the regeneration process is performed, the period of the regeneration process becomes longer. Due to this, while the regeneration process is performed, the period of the regeneration process can be set at any time so that, if the temperature of the attachment element is low, the period of the regeneration process is long, thereby being able to avoid the situation where a part of particulate matter remains after burning, and, if the temperature of the attachment element is high, the period of the regeneration process is short, thereby being able to avoid the unnecessarily long length of the regeneration period. Therefore, the target temperature and the length of the regeneration period are properly set at any time while the regeneration process is performed, thereby being able to realize a detection apparatus that can be regenerated, avoiding excess PM burning, unnecessarily long regeneration periods, and PM remaining after PM sensor regeneration.

The detection apparatus may further comprise a calculation unit that calculates an attached amount of particulate matter which attaches to the attachment element while the regeneration process is performed. The second setting unit may include a completion determination unit that determines that the regeneration process is completed when the attached amount of particulate matter, which is calculated by the calculation unit while the regeneration process is performed, becomes smaller than a predetermined value.

According to this, while the regeneration process is performed, the attached amount of particulate matter is calculated at any time, and, when the calculation value becomes smaller than the predetermined value, the regeneration process is completed. Due to this, the regeneration process can be completed at optimum timing using the attached amount of particulate matter of high accuracy that is calculated at any time while the regeneration process is performed. Therefore, the regeneration process can be completed at optimum timing, thereby being able to realize a detection apparatus that can be regenerated, avoiding excess PM burning, unnecessarily long regeneration periods, and PM remaining after PM sensor regeneration.

The detection apparatus may further comprise a temperature detection unit that detects a temperature of the exhaust gas which flows through the exhaust path. The second setting unit may include a seventh setting unit that sets the completion timing of the regeneration process so that the period of the regeneration process becomes longer, as the temperature of the exhaust gas detected by the temperature detection unit becomes lower.

According to this, as the temperature of the exhaust gas becomes lower, the period of the regeneration process becomes longer. If the temperature of the exhaust gas is low, the period of the regeneration is long in consideration of burning being weakened, thereby being able to avoid the situation where a part of particulate matter remains after burning. If the temperature of the exhaust gas is high, the period of the regeneration is short, thereby being able to set the period of the regeneration process that can avoid the unnecessarily long length of the regeneration period. Therefore, the target temperature and the length of the regeneration period are properly set based on the temperature of the exhaust gas, thereby being able to realize a detection apparatus that can be regenerated, avoiding excess PM burning, unnecessarily long regeneration periods, and PM remaining after PM sensor regeneration.

The detection apparatus may further comprise a flow rate detection unit that detects a flow rate of the exhaust gas which flows through the exhaust path. The second setting unit may include a eighth setting unit that sets the completion timing of the regeneration process so that the period of the regeneration process becomes longer, as the flow rate of the exhaust gas detected by the flow rate detection unit becomes larger.

According to this, as the flow rate of the exhaust gas becomes larger, the period of the regeneration process becomes longer. If the flow rate of the exhaust gas is large, the period of the regeneration is long in consideration of heat that is removed by the exhaust gas flow, thereby being able to avoid the situation where a part of particulate matter remains after burning. If the flow rate of the exhaust gas is small, the period of the regeneration is short, thereby being able to set the period of the regeneration process that can avoid the unnecessarily long length of the regeneration period. Therefore, the target temperature and the length of the regeneration period are properly set based on the flow rate of the exhaust gas, thereby being able to realize a detection apparatus that can be regenerated, avoiding excess PM burning, unnecessarily long regeneration periods, and PM remaining after PM sensor regeneration.

The correlation value may be a value of current flowing in particulate matter which attaches to the attachment element. The detection apparatus may further comprise a correction unit that, while the regeneration process is performed, corrects the correlation value based on the temperature of the attachment element to calculate the attached amount of particulate matter in the attachment element.

According to this, the detection unit detects the value of current flowing in particulate matter which attaches to the attachment element, and subsequently an output of the detection unit is corrected based on the temperature of the attachment element. Due to this, the output value is corrected appropriately by using a property that, as the temperature of the attachment element becomes higher, the electric resistance of attached particulate matter changes. Therefore, even if the output value of the detection unit is influenced by the change in the electric resistance due to the temperature, the output value is properly corrected and the influence is removed, thereby being able to calculate the attached amount of particulate matter during the regeneration process with a high degree of accuracy.

The calculation unit may include: a estimation unit that estimates a burned amount of particulate matter per unit time while the regeneration process is performed; and a subtraction unit that subtracts the burned amount estimated by the estimation unit from an amount of particulate matter corresponding to the correlation value which is detected by the detection unit before a start of the regeneration process so as to calculate the attached amount of particulate matter while the regeneration process is performed.

According to this, the estimated value of burned amount during the regeneration process is subtracted from the attached amount of particulate matter before the start of the regeneration process to thereby calculate the attached amount of particulate matter during the regeneration process. Due to this, the attached amount of particulate matter during the regeneration process is calculated with a high degree of accuracy, without using the output of the detection unit during the regeneration.

DETAILED DESCRIPTION OF THE PREFERRED EMBODIMENTS

With reference to the accompanying drawings, hereinafter are described some embodiments of the present invention.

First Embodiment

Figure 1:
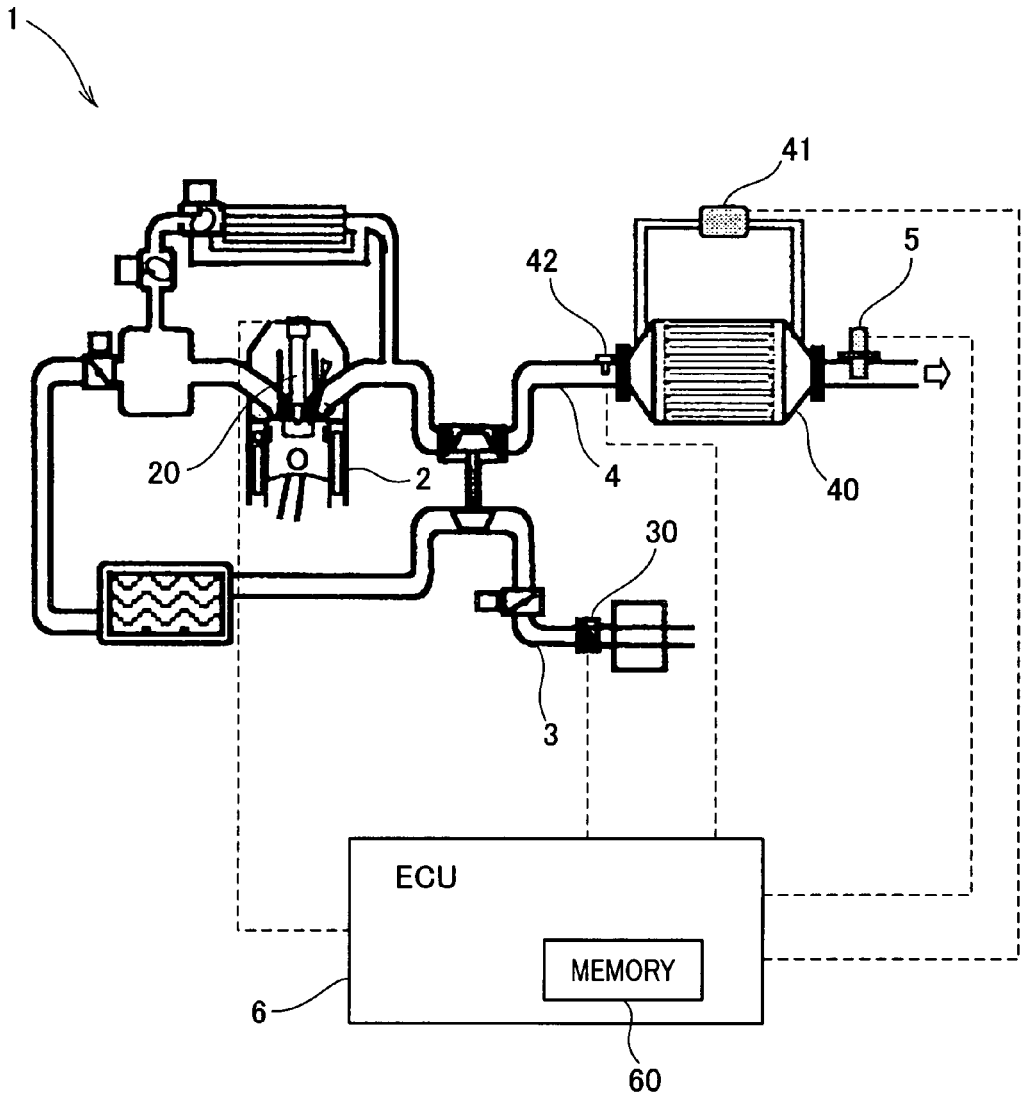
FIG. 1 is a schematic diagram illustrating a configuration of a detection apparatus according to a first embodiment of the present invention.

FIG. 1 is a schematic diagram illustrating a detection system (detection apparatus) 1 according to a first embodiment of the present invention. The detection system 1 may be applied to e.g., an automotive vehicle.

The detection system 1 is a system that detects an amount of PM flowing through an exhaust pipe (exhaust path) 4 of a diesel engine 2 (engine) that is an internal combustion engine. The detection system 1 includes an intake pipe 3, the exhaust pipe 4, a PM sensor 5, and an electronic control unit 6. Through the intake pipe 3, intake gas (air) is supplied to the engine 2. The intake pipe 3 is provided with an air flow meter 30 that detects an intake volume (e.g., a mass flow rate per unit time). In a cylinder of the engine 2, fuel is injected by an injector 20.

The exhaust pipe 4 is provided with a DPF 40, a differential-pressure meter 41, and an exhaust gas temperature sensor 40. The DPF 40 collects PM emitted by the engine 2. The differential-pressure meter 41 detects a pressure difference between inlet and outlet of DPF 40 (a difference value between a pressure at an upstream side and a pressure at downstream side of DPF 40). The PM sensor 5 is arranged at a downstream side of the DPF 40 in the exhaust pipe 4 and detects an amount of PM passing through the DPF 40.

The DPF 40 may have, as an example of a typical structure, so called honeycomb structure whose inlet and outlet are alternately closed. Particulate matter (PM) is included in the exhaust gas that is emitted from the engine 2 in operation thereof, and, when the exhaust gas passes through a wall of the DPF 40 having the above structure, PM is collected at the inside and the surface of the wall of the DPF 40, and then the exhaust gas, which is emitted to the outside of, e.g., the automotive vehicle, is purified. The DPF 40 may be, for example, a DPF that supports oxidation catalysis.

Each time an amount of PM accumulated in the DPF 40 becomes sufficiently large, the accumulated PM is burned and removed, thereby regenerating the DPF 40. An example of a method for estimating the amount of PM accumulated may be a method that comprises: obtaining in advance a functional relationship (map) between the amount of PM accumulated and the pressure difference between inlet and outlet of DPF 40 to store the map in the memory 61; and estimating the amount of PM accumulated based on an detection value of the differential-pressure meter 41 and the map stored in the memory 61. The map has, as a typical property, such a relationship that has a shape of a parallelogram in which the amount of PM accumulated is allocated to the horizontal axis of the map and the pressure difference between inlet and outlet of DPF 40 is allocated to the vertical axis of the map, and the PM/pressure relationship makes a circuit of the parallelogram, when PM is accumulated and is burned.

The electronic control unit (ECU) 6 has a configuration similar to that of a normally used computer and includes a CPU (central processing unit) for carrying out several calculations and a memory 60 for storing various pieces of information. The ECU 6 performs various controls to, e.g., obtain detection values of the above various sensors, and instruct an amount of fuel injection of the injector 20. The ECU 6 also adjusts a regeneration period and a target temperature in the regeneration of the PM sensor 5, which correspond to the exemplary main object of the present embodiment.

Figure 18A:
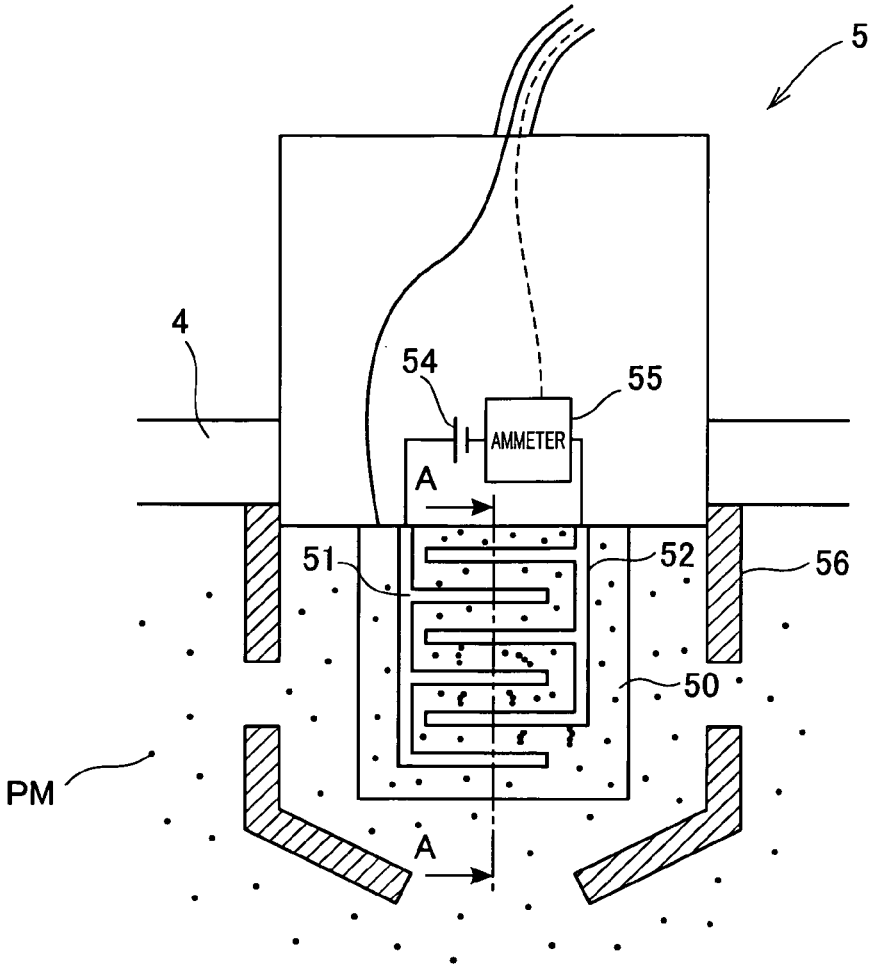
FIG. 18A is a schematic diagram illustrating an example of a structure of a PM sensor.
Figure 18B:
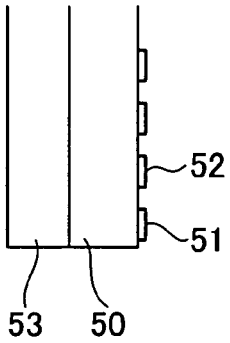
FIG. 18B is a cross section view taken along the line A-A of FIG. 18A.

FIG. 18 shows an example of the structure of the PM sensor 5. The PM sensor 5 includes a plate-shaped insulator 50 (attachment element) and a pair of electrodes 51 and 52 formed on the insulator 50. The entirety is covered with a cover 56 made of metal or the like. A number of holes are formed in the cover 56 PM flows into the through the holes. PM has viscosity and thus attaches to an electrode portion (e.g., the insulator 50, the electrodes 51 and 52) and then is accumulated thereon. PM also has electrical conductivity. Therefore, when PM is accumulated on the insulator 50 to connect the electrodes 51 and 52, an electrically conductive state is created across the electrodes 51 and 52.

A DC power supply 54 applies voltage across the electrodes 51 and 52. When the electrically conductive PM is accumulated on the insulator 50 and an electrically conductive state is created across the electrodes 51 and 52, current passes across the electrodes 51 and 52. The current is measured by an ammeter 55 and its measured current value is supplied, as a sensor output, from the PM sensor 5 to the ECU 6. The current value outputted by the PM sensor 5 is an amount that is correlated with an attached amount of PM attached on the insulator 50 (and an amount of PM that flows through the exhaust pipe 4). The DC power supply 54 may be a battery of the vehicle.

A heater 53 is located on the opposite side of the insulator 50 with respect to the electrodes 51 and 52. The heater 53 may be, for example, a metal wire (conductor wire). Under the control of the ECU 6, current is passed through the heater 53 to raise the temperature of the heater 53 with its electrical resistance. Thus, the PM accumulated on the surface of the insulator 50 is burned and removed. As a result, the PM sensor 5 is regenerated.

Figure 16:
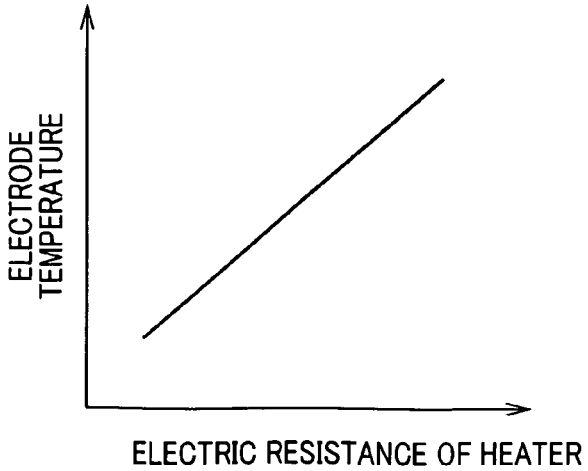
FIG. 16 is a graph illustrating an example of a correlation between an electric resistance of a heater and an electrode temperature.
Figure 17:
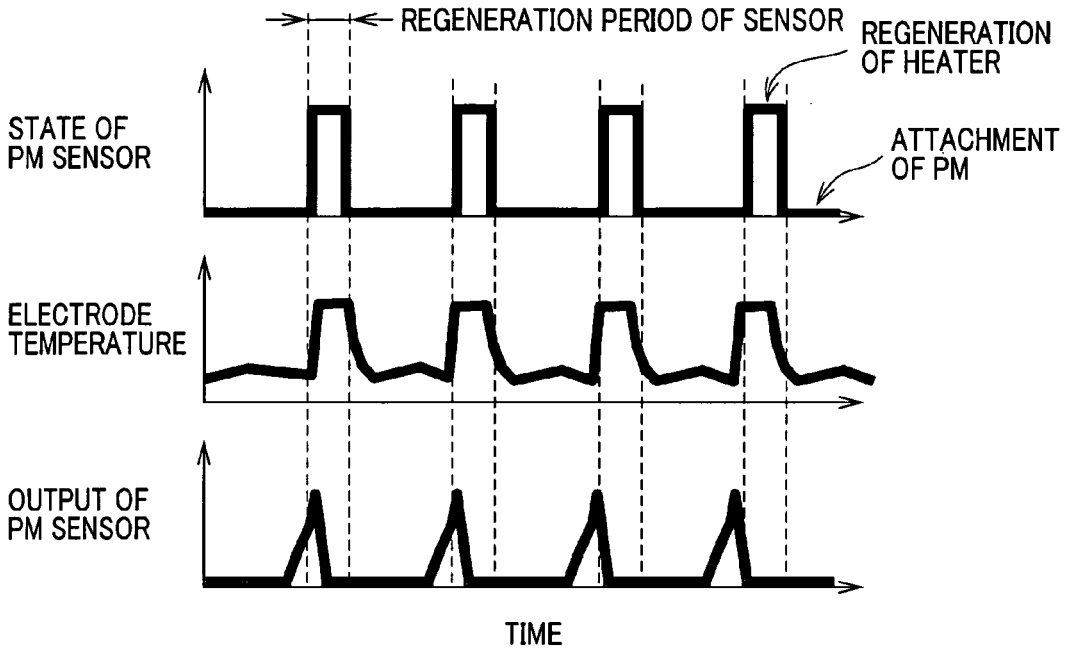
FIG. 17 is a schematic diagram illustrating an example of a temporal change in a state of a PM sensor, an electrode temperature, and an output of the PM sensor.

The ECU 6 detects a voltage value and current value of current passing through the heater 53 to obtain an electric resistance of the heater 53 through a division calculation based on the detected voltage value and current value. As is well known, the electrical resistance changes depending on temperature. Thus, as shown in an example of FIG. 16, the ECU 6 is able to detect the temperature of the heater 53, i.e. approximately detect the temperature of the insulator 50. The property shown in FIG. 16 may be obtained in advance based on the material (e.g., platinum) of the heater 53 that is used, and be stored in the memory 60.

In the above configuration, the detection system 1 according to the present embodiment performs a control for a completion of a regeneration process of the PM sensor 5 and a target temperature during the regeneration. Its procedure of the detection system 1 is shown in a flowchart of FIG. 2. The procedure of FIG. 2 (and FIGS. 5, 8, 9, and 11 to be hereinafter described) may be programmed and stored in advance in, for example, the memory 60 of the ECU 6, and be automatically and repeatedly executed by the ECU 6 in operation of the engine 2.

Figure 2:
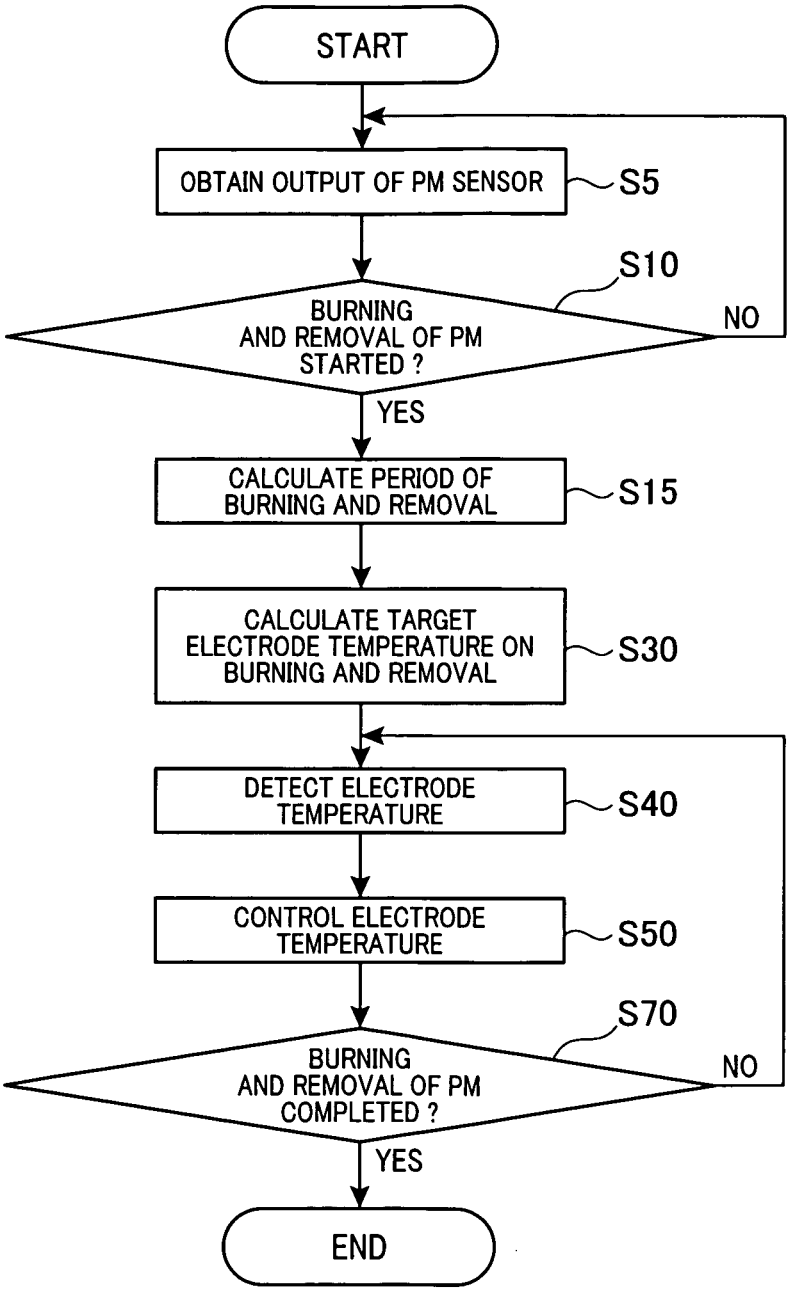
FIG. 2 is a flowchart illustrating a regeneration process of a PM sensor performed by the detection apparatus according to the first embodiment.

In the process of FIG. 2, at step S5, the ECU 6 obtains an output value of the PM sensor 5. Then, at step S10, the ECU 6 determines whether or not the output value of the PM sensor 5 reaches a predetermined value needed for the regeneration (burning and removal of PM attaching to the insulator 50 of the PM sensor 5), i.e., the regeneration is started. As a result, if the regeneration is started (YES in step S10), the ECU 6 proceeds to step S15, and, if the regeneration is not started (NO in step S10), the ECU 6 returns to step S5.

Figure 4:
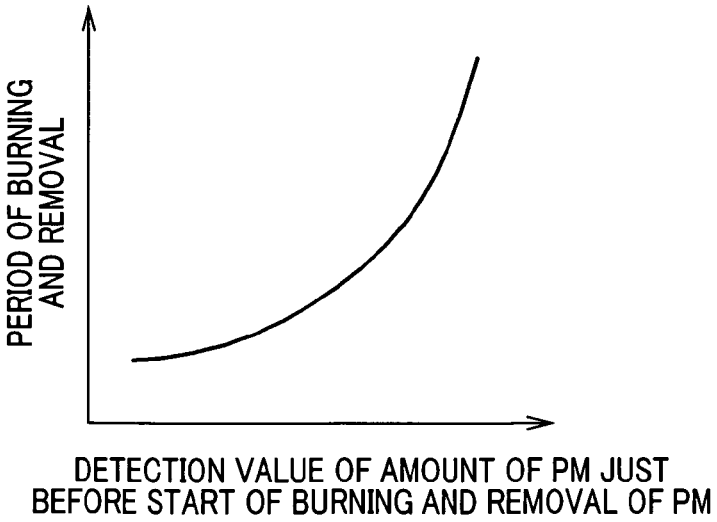
FIG. 4 is a graph illustrating an example of a correlation between a detection value of an amount of PM, just before a start of burning and removal, and a period of burning and removal.

Then, at step S15, the ECU 6 calculates a length of the regeneration period (burning and removal period). An example of its concrete calculation method is shown in FIG. 4. FIG. 4 shows a diagram illustrating an appropriate period of the regeneration (burning and removal of PM) of the PM sensor 5 based on a detection value of an amount of PM (horizontal axis) just before or at a start of the regeneration process of the PM sensor 5. As shown in FIG. 4, it is preferable that, as an attached amount of PM just before the start of the regeneration process of the PM sensor 5 becomes larger, the regeneration period is set to become longer, because the situation where a part of PM remains after burning can be avoided. A map of FIG. 4 may be stored in advance in the memory 60.

Figure 3:
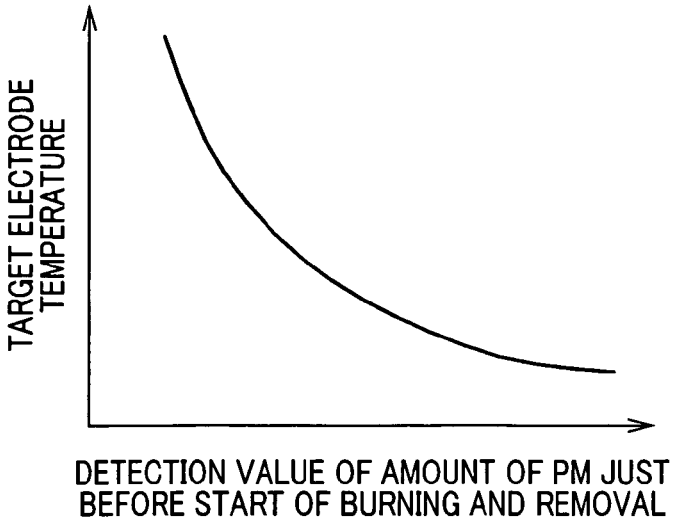
FIG. 3 is a graph illustrating an example of a correlation between a detection value of an amount of PM, just before a start of burning and removal, and a target electrode temperature.

Then, at step S30, the ECU 6 calculates a target temperature of the electrode portion during a period of burning and removal of PM. This calculation process is performed based on, for example, FIG. 3. FIG. 3 shows a diagram illustrating an appropriate target electrode temperature (vertical axis) based on a detection value of an amount of PM (horizontal axis) just before a start of the burning and removal. As shown in FIG. 3, it is preferable that, as an attached amount of PM just before the start of the regeneration process of the PM sensor 5 becomes larger, the target electrode temperature is set to become lower, because an occurrence of a malfunction such as a damage of the PM sensor 5 due to the excess burning can be avoided if the attached amount of PM is large, and PM can be quickly burned if the attached amount of PM is small. A map of FIG. 3 may be stored in advance in the memory 60.

Then, at step S40, the ECU 6 detects an electrode temperature. Here, the temperature of the heater 53 may be regarded as the electrode temperature. The temperature of the heater 53 is calculated based on the electric resistance of the heater 53 calculated as mentioned above and the property of FIG. 16 stored in the memory 60. Subsequently, at step S50, the ECU 6 controls the electrode temperature. Here, the ECU 6 may perform a feedback control so that the electrode temperature detected in step S40 follows the target temperature calculated in step S30.

Then, at step S70, the ECU 6 determines whether or not the regeneration process of the PM sensor 5 (the burning and removal of PM attaching to the PM sensor 5) is completed. As a result, if the regeneration process is completed (YES in step S70), the process of FIG. 2 is completed, and, if the regeneration process is not completed (NO in step S70), the ECU 6 returns to step S40 and repeats the above process. If the ECU 6 determines the completion (YES in step S70), the ECU 6 completes the regeneration process of the PM sensor 5. Specifically, if the regeneration period set in step S15 passes, the ECU 6 may determine that the regeneration process of the PM sensor 5 is completed. In order to achieve this process, the ECU 6 may have a timer function.

The above is the first embodiment. As mentioned above, according to the first embodiment, the length of the regeneration period (step S15) and the target temperature (step S30) is set before the start of the regeneration process of the PM sensor 5. Here, as the attached amount of PM just before the start of the regeneration process becomes larger, the length of the regeneration period becomes longer, thereby being able to avoid the situation where a part of PM remains after burning. As the attached amount of PM just before the start of the regeneration process becomes larger, the target temperature becomes lower, thereby being able to avoid the excess burning and to achieve quick burning.

Second Embodiment

Next, a second embodiment of the present invention is described. In the second embodiment, while the regeneration process is performed, the attached amount of the remaining PM in the PM sensor is calculated, the target electrode temperature is adjusted based on the attached amount of the remaining PM during the regeneration, and the regeneration period is also adjusted based on the electrode temperature during the regeneration.

Figure 5:
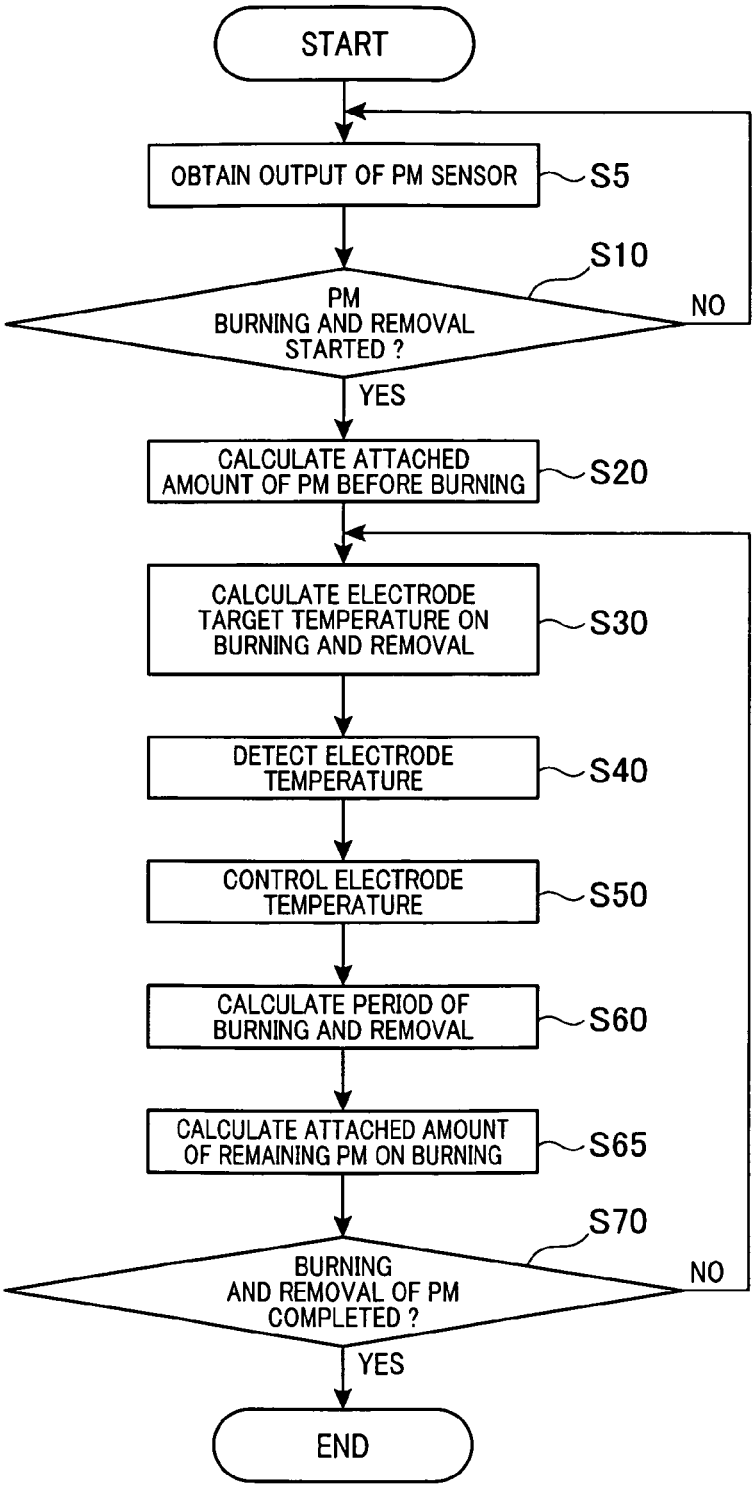
FIG. 5 is a flowchart illustrating a regeneration process of a PM sensor performed by the detection apparatus according to a second embodiment of the present invention.

The configuration of FIG. 1 is also used in the second embodiment. Hereinafter, a part of the second embodiment different from the first embodiment is described. In the second embodiment, processes in steps of a flowchart shown in FIG. 5, not FIG. 2, are executed. In the flowchart of FIG. 5, steps S5, S10, S30, S40, S50, and S70 (the same references as FIG. 2) are the same as that of FIG. 2. Step S15 of FIG. 2 is omitted from the flowchart of FIG. 5. In FIG. 2, steps S20, S60 and S65 are newly added and executed. At step S70, if the ECU 6 judges NO, the ECU 6 returns to step S30.

At step S20, the ECU 6 calculates the attached amount of PM based on the detection value of the PM sensor 5 just before the start of the regeneration process. In order to perform the process, a map, which shows a relationship between the output value of the PM sensor 5 and the attached amount of PM in the insulator 50, may be stored in advance in the memory 60 and be used in step S20.

Figure 6:
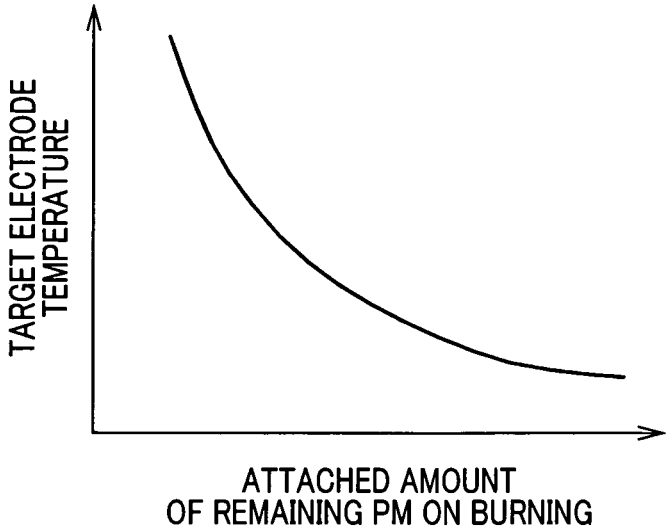
FIG. 6 is a graph illustrating an example of a correlation between an attached amount of remaining PM on burning and a target electrode temperature.

At step S30 of FIG. 5, the ECU 6 calculates the target electrode temperature based on the attached amount of PM (the attached amount of the remaining PM during burning) in the PM sensor 5 during the regeneration process of the PM sensor 5. This calculation is performed based on e.g., FIG. 6. FIG. 6 shows a diagram illustrating an appropriate target electrode temperature (vertical axis) based on an attached amount of the remaining PM on the burning (horizontal axis). As shown in FIG. 6, it is preferable that, as an attached amount of PM during the regeneration process of the PM sensor 5 becomes larger, the target electrode temperature is set to become lower, because an occurrence of a malfunction such as damage to the PM sensor 5 due to the excess burning can be avoided. A map of FIG. 6 may be stored in advance in the memory 60. The attached amount of the remaining PM on the burning of the vertical axis of FIG. 6 is calculated in step S65 to be described below.

Figure 7:
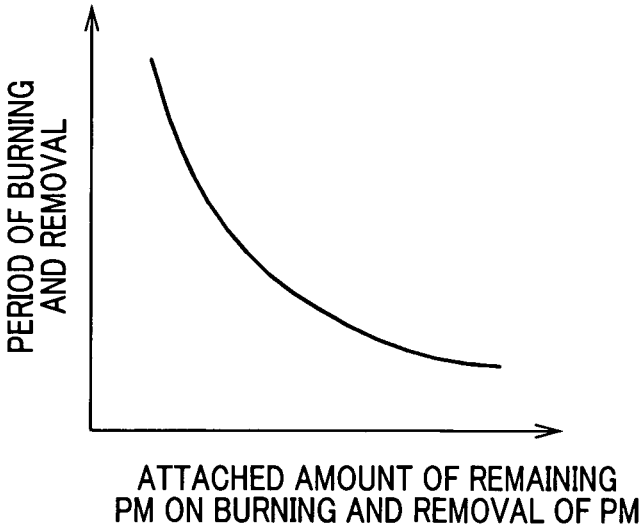
FIG. 7 is a graph illustrating an example of a correlation between an electrode temperature on burning and removal of PM and a period of burning and removal.

At step S60, the ECU 6 calculates the burning and removal period (the regeneration period) based on the electrode temperature obtained in step S40. A concrete calculation method is performed based on FIG. 7. FIG. 7 shows a diagram illustrating an appropriate length (horizontal axis) of the period of the regeneration process (burning and removal) of the PM sensor 5 based on an electrode temperature (vertical axis) during the regeneration process of the PM sensor 5. As shown in FIG. 7, it is preferable that, as the electrode temperature during the regeneration process becomes lower, the length of the period of the regeneration process is set to become longer, and, as the electrode temperature becomes higher, the length of the period of the regeneration process is set to become shorter, because the excess burning and the situation where a part of PM remains after burning can be avoided. A map of FIG. 7 may be stored in advance in the memory 60.

Subsequently, at step S65, the ECU 6 calculates the attached amount of the remaining PM during the burning. A concrete calculation in step S65 is performed by using a method based on e.g., FIG. 8 or a method based on FIGS. 9 and 10. The method based on FIG. 8 is a method that corrects the output value of the PM sensor 5 during the regeneration of the PM sensor 5 based on the electrode temperature to thereby calculate the attached amount of the remaining PM during the burning.

Figure 8:
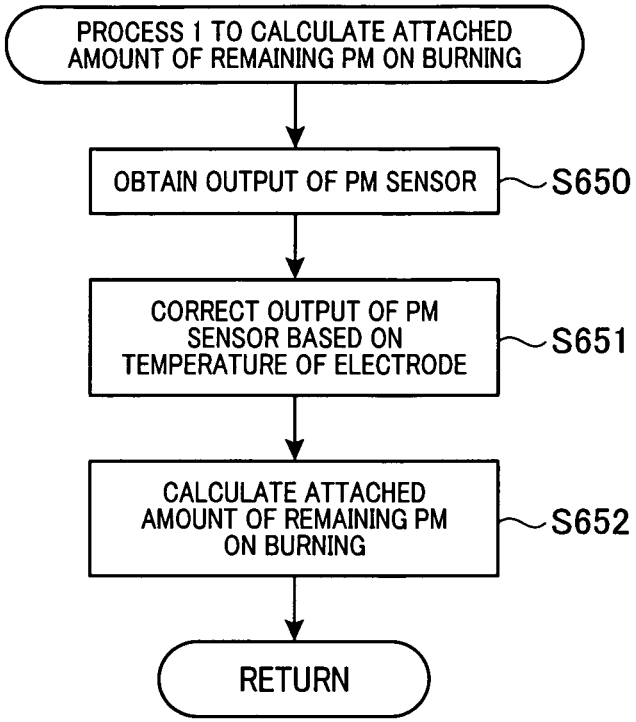
FIG. 8 is a flowchart illustrating a first example of a process to calculate an attached amount of remaining PM on burning.

Specifically, in the process of FIG. 8, at step S650, the ECU 6 obtains an output value of the PM sensor 5. Then, at step S651, the ECU 6 corrects the output value of the PM sensor 5 obtained in step S650. The current value corresponding to the output value of the PM sensor 5 may become large during the regeneration process of the PM sensor 5 (particularly, just after the start of regeneration process). The inventors have acquired a knowledge that the above phenomenon is caused by a property where a high temperature decreases the electric resistance of PM.

Accordingly, the current value of the PM sensor 5 during the regeneration process of the PM sensor 5 does not always reflect the attached amount of PM with maximum accuracy, and then it is desirable to correct the output value of the PM sensor 5 so as to eliminate (remove) the effect of a change in the electric resistance due to temperature. At step S651, the ECU 6 performs such a correction. For example, a map that shows a relationship between a temperature and a correction coefficient may be stored in advance in the memory 60, and then, at step S651, the ECU 6 may obtain the correction coefficient based on this map and the electrode temperature obtained in step S40 and correct the output value of the PM sensor 5 based on the correction coefficient, e.g., multiply the output value of the PM sensor 5 by the correction coefficient.

Subsequently, at step S652, the ECU 6 calculates the attached amount of the remaining PM of the PM sensor 5 based on the output value corrected in step S651. This calculation is performed based on the same map as mentioned above. The above is an example of the calculation process in step S65 based on FIG. 8.

Figure 9:
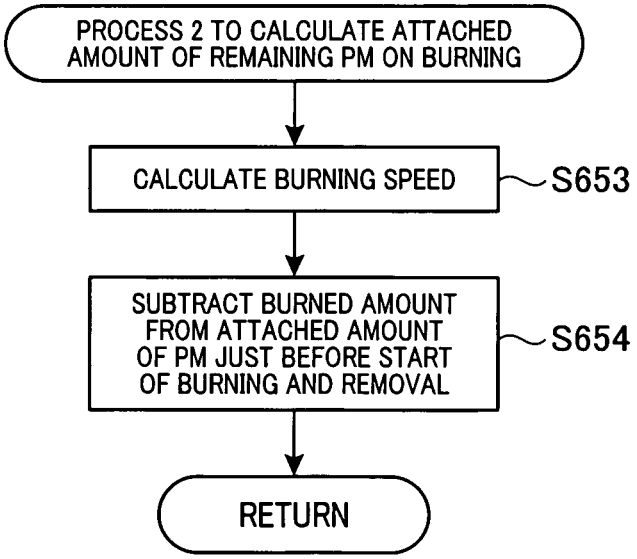
FIG. 9 is a flowchart illustrating a second example of a process to calculate an attached amount of remaining PM on burning.
Figure 10:
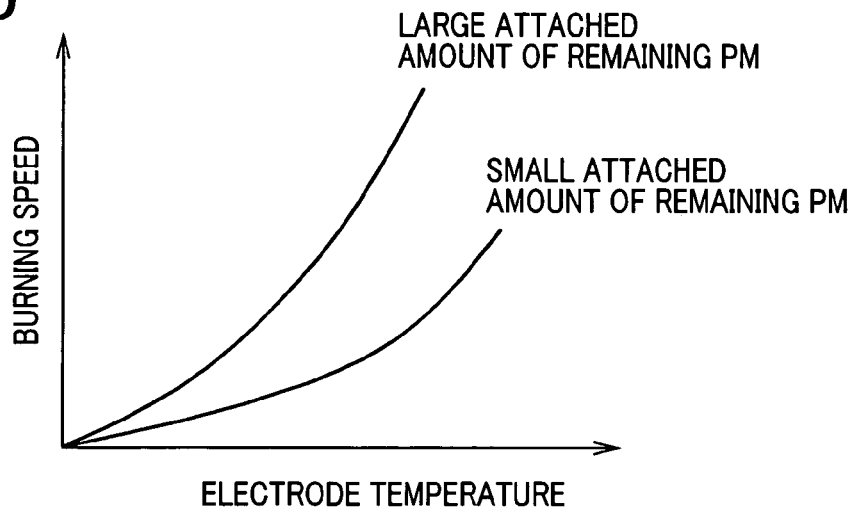
FIG. 10 is a graph illustrating an example of a correlation between an electrode temperature and a burning speed.

Next, the calculation method of the attached amount of PM based on FIGS. 9 and 10 is a method that calculates a burning speed based on a map as described below, and subtracts the calculated burning speed from the attached amount of PM just before the start of the regeneration process to calculate the attached amount of the remaining PM. Specifically, first, at step S653, the ECU 6 calculates the burning speed of the PM sensor 5. This calculation is performed according to, e.g., a map of FIG. 10. FIG. 10 is a map that shows the burning speed (vertical axis) of PM that attaches to the insulator 50 every value of electrode temperature (horizontal axis).

As shown in FIG. 10, a relationship between the electrode temperature and the burning speed (burned amount per unit time) differs depending on the attached amount of the remaining PM in the PM sensor 5. As the attached amount of the remaining PM becomes larger, the burning reaction becomes more active and then the burning speed also becomes larger. The map of FIG. 10 may be obtained in advance and be stored in the memory 60.

Subsequently, the ECU 6 subtracts a burned amount corresponding to the burning speed calculated in step S653 from the attached amount of PM in the PM sensor 5 just before the start of the regeneration process (burning and removal process) of the PM sensor 5.

The process of FIG. 9 is repeatedly performed during the regeneration process. From this, the burned amount at any time has been subtracted from the attached amount of PM just before the start of the regeneration process. As a result, the burned amount at this time is calculated. The above is an example of the calculation process in step S65 based on FIGS. 9 and 10.

The above is the second embodiment. As mentioned above, according to the second embodiment, the length of the regeneration period (step S60) and the target temperature (step S30) are adjusted during the regeneration process of the PM sensor 5. Here, as the attached amount of the remaining PM during the regeneration process becomes larger (or smaller), the target temperature becomes lower (or higher), thereby being able to avoid the excess burning and the situation where a part of PM remains after burning. As the electrode temperature during the regeneration process becomes lower (or higher), the regeneration period becomes longer (or shorter), thereby being able to also avoid the excess burning and the situation where a part of PM remains after burning.

Third Embodiment

Next, a third embodiment of the present invention is described. In the third embodiment, the regeneration period is not calculated as the first and second embodiments, but the attached amount of the remaining PM in the PM sensor 5 during the regeneration process of the PM sensor 5 is calculated, and, if the attached amount of the remaining PM becomes sufficiently small, the regeneration process is completed. The configuration of FIG. 1 is also used in the third embodiment. Hereinafter, a part of the third embodiment different from the second embodiment is described.

Figure 11:
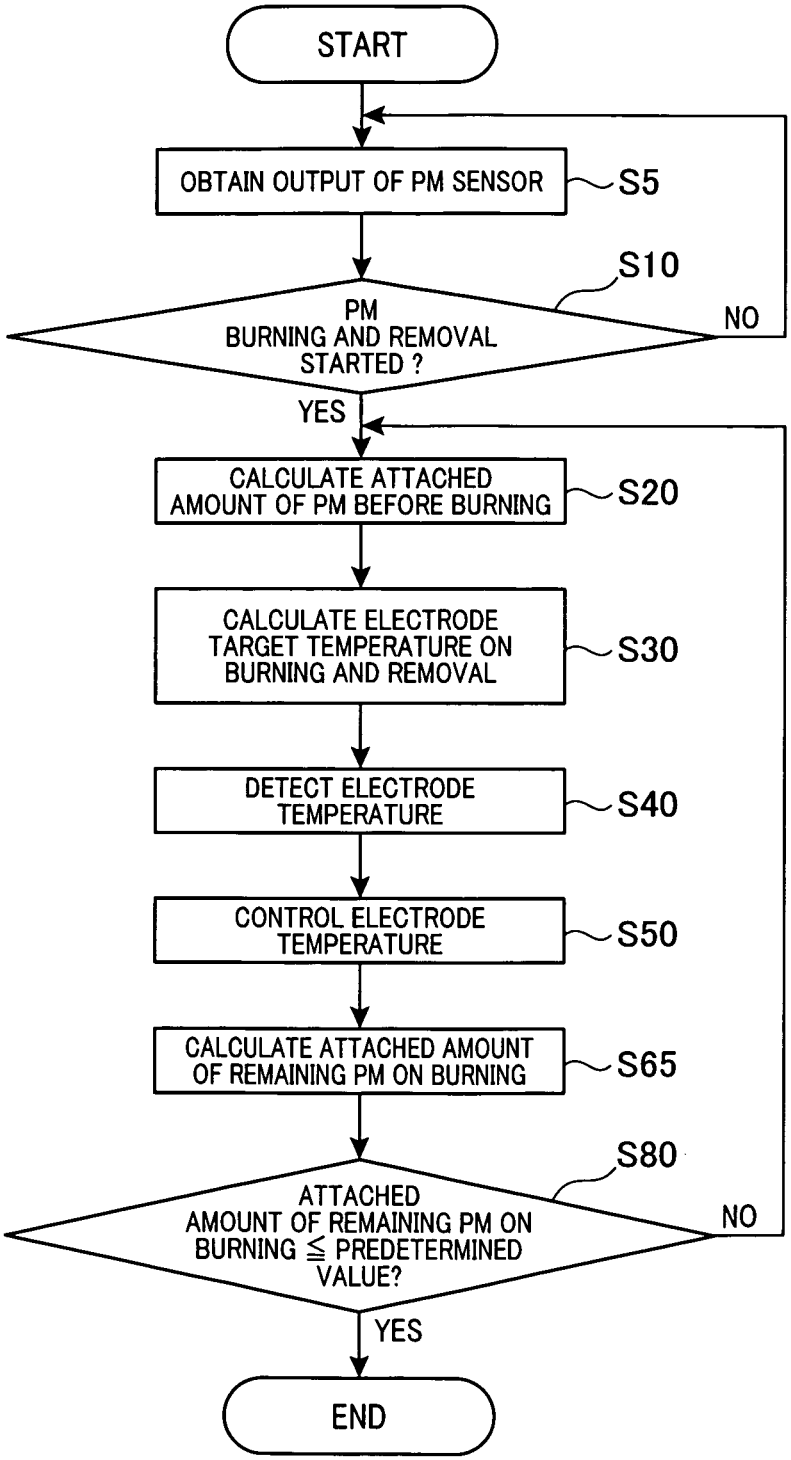
FIG. 11 is a flowchart illustrating a regeneration process of a PM sensor performed by the detection apparatus according to a third embodiment of the present invention.

In the third embodiment, processes in steps of a flowchart shown in FIG. 11, not FIG. 5, are executed. In the flowchart of FIG. 11, each steps S5, S10, S20, S30, S40, S50, and S65 (the same references as FIG. 2) is the same process as those of FIG. 5. Step S60 of FIG. 5 is omitted from the flowchart of FIG. 11, because the calculation of the regeneration period is unnecessary. The process in step S70 of FIG. 5 is changed to a process in step S80 of FIG. 11.

At step S80, the ECU 80 judges whether or not the attached amount of the remaining PM calculated in step S65 is a predetermined value or less. As a result, if the attached amount of the remaining PM is a predetermined value or less (YES in step S80), the ECU 6 judges a completion of the regeneration and completes the process of FIG. 11. If the attached amount of the remaining PM is larger than a predetermined value (NO in step S80), the ECU 6 returns to step S30 and repeats the above subsequent process. If the ECU 6 judges the completion of the regeneration (YES in step S80), the ECU 6 completes the regeneration process.

Figure 12:
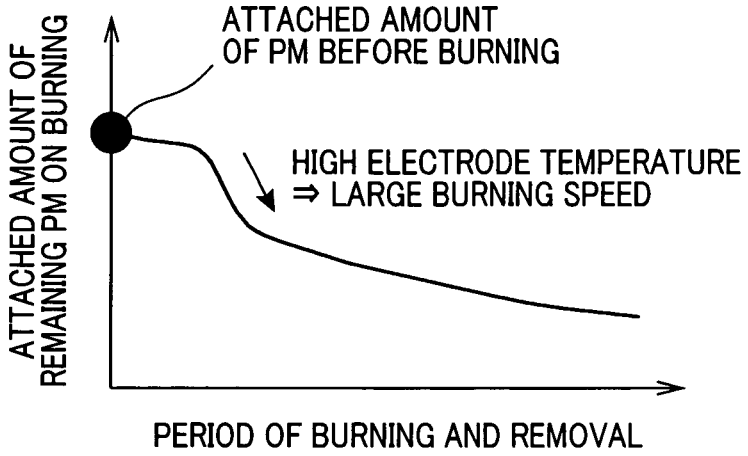
FIG. 12 is a schematic diagram illustrating a temporal change in an attached amount of remaining PM on burning.

FIG. 12 shows an example of a temporal change in the attached amount of the remaining PM on the burning. As shown in FIG. 12, as the regeneration time passes, the amount of PM attaching to the insulator 50 of the PM sensor 50 decreases, and, at any point in time, the ECU 6 judges YES in step S80 of FIG. 11. According to this, the attached amount of the remaining PM is calculated (estimated) at any time and then, if the attached amount becomes sufficiently small, the regeneration process of the PM sensor 5 is completed, thereby being able to avoid the situation where a part of PM remains after burning and to meet a condition that the regeneration period is not unnecessarily long.

The above is the third embodiment. As mentioned above, according to the third embodiment, the attached amount of the remaining PM is calculated during the regeneration process of the PM sensor 5, and then, if the attached amount is the predetermined value or less, the generation process is completed. Due to this, when PM attaching to the insulator 50 is sufficiently burned, the regeneration process can be completed immediately. Accordingly, the regeneration process can be completed at the most appropriate time.

Fourth Embodiment

Next, a fourth embodiment of the present invention is described. In the fourth embodiment, a process, which adjusts the regeneration period (burning and removal period) based on an exhaust gas temperature and an exhaust gas flow rate, is added. The configuration of FIG. 1 is also used in the fourth embodiment. Hereinafter, a part of the fourth embodiment different from the first embodiment is described.

Figure 13:
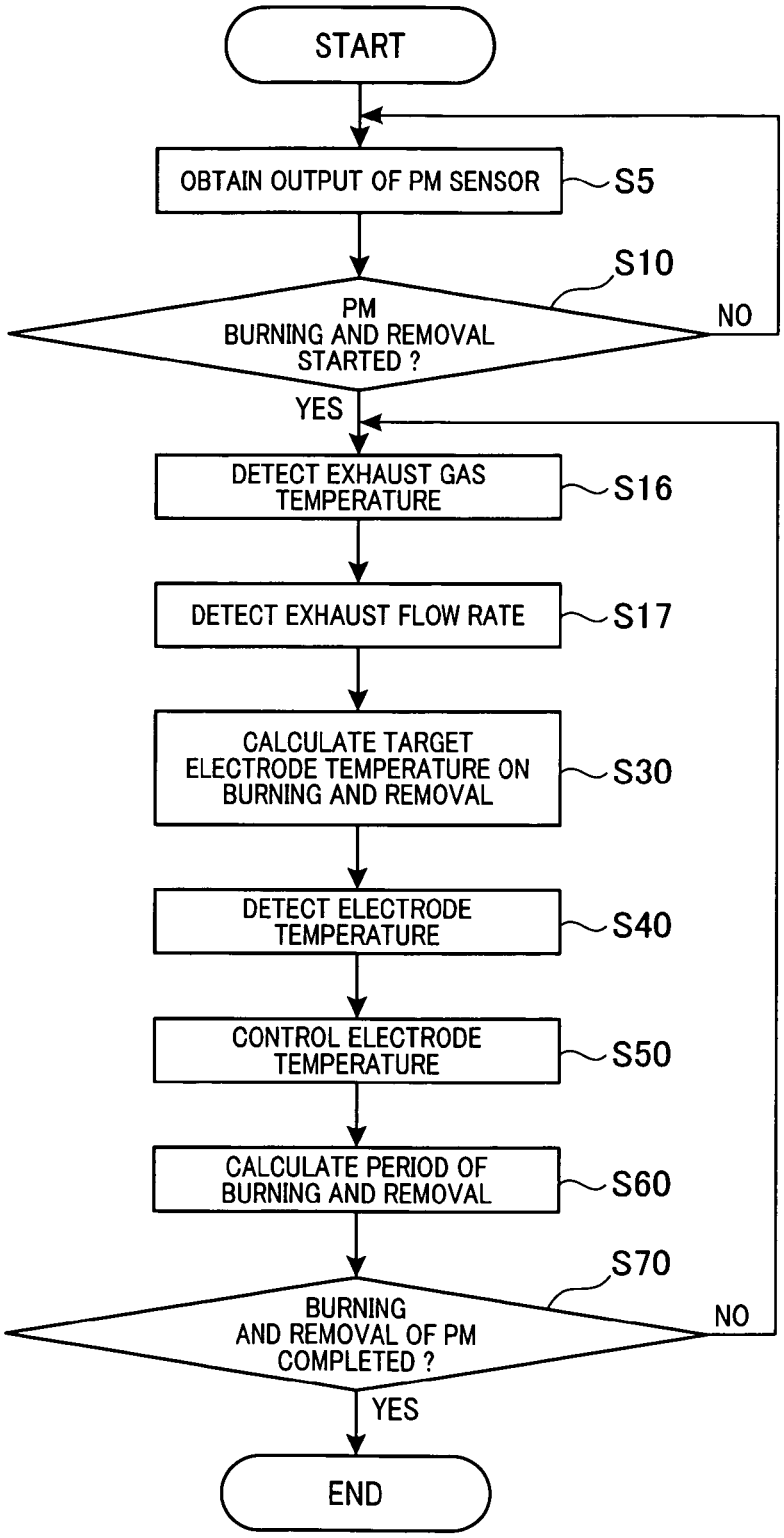
FIG. 13 is a flowchart illustrating a regeneration process of a PM sensor performed by the detection apparatus according to a fourth embodiment of the present invention.

In the fourth embodiment, processes in steps of a flowchart shown in FIG. 13, not FIG. 2, are executed. In the flowchart of FIG. 13, each steps S5, S10, S30, S40, S50, and S70 (the same references as FIG. 2) is the same process as that of FIG. 2. Step S15 of FIG. 2 is omitted from the flowchart of FIG. 13. In FIG. 2, steps S16, S17 and S60 are newly added and executed. At step S70, if the ECU 6 judges NO, the ECU 6 returns to step S16.

At step S16, the ECU 6 detects an exhaust gas temperature. This exhaust gas temperature may be detected through the exhaust gas temperature sensor 42. Then, at step S17, the ECU 6 detects an exhaust gas flow rate. Here, a detection value detected by the air flow meter 30 may be regarded as the exhaust gas flow rate, providing that a flow rate of the exhaust gas is approximately the same value as that of the intake air.

At step S60, the ECU 6 calculates the regeneration period (burning and removal period) based on the exhaust gas temperature detected in step S16 and the exhaust gas flow rate detected in step S17. In this case, for example, as mentioned in the above step S15, the ECU 6 may obtain a reference value of the regeneration period based on the output value of the PM sensor 5 just before the start of the regeneration process, and subsequently, corrects the reference value based on the exhaust gas temperature and the exhaust gas flow rate. This correction may be performed based on, e.g., the relationships shown in FIGS. 14 and 15.

Figure 14:
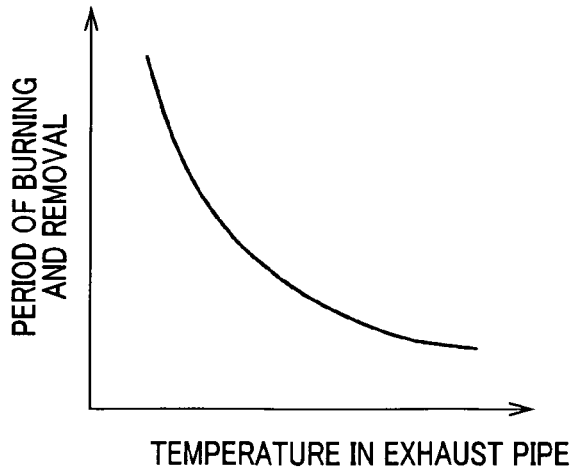
FIG. 14 is a graph illustrating an example of a correlation between a temperature in an exhaust pipe and a period of burning and removal.
Figure 15:
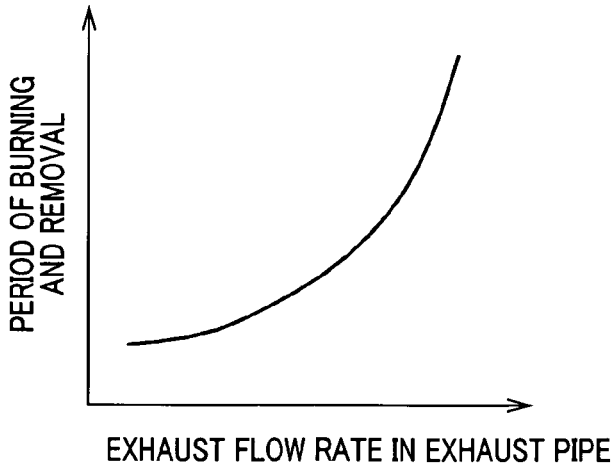
FIG. 15 is a graph illustrating an example of a correlation between an exhaust flow rate in an exhaust pipe and a period of burning and removal.

FIG. 14 shows an appropriate length (vertical axis) of the burning and removal period based on the exhaust gas temperature (horizontal axis) in the exhaust pipe 4. As shown in FIG. 14, as the exhaust gas temperature becomes higher, the regeneration period may be shorter, because there is a trend that, as the exhaust gas temperature becomes higher, a temperature of PM during the regeneration process also becomes higher. FIG. 15 shows an appropriate length (vertical axis) of the burning and removal period based on the exhaust gas flow rate (horizontal axis) in the exhaust pipe 4. As shown in FIG. 15, as the exhaust gas flow rate becomes larger, the regeneration period is needed to be longer, because there is a trend that, as the exhaust gas flow rate becomes larger, heat is removed by the exhaust gas from PM during the regeneration process toward a downstream side. For example, provided that each vertical axis of FIGS. 14 and 15 is allocated to a correction coefficient, the above correction may be performed by multiplying the reference value of the regeneration period by the correction coefficient. Here, maps corresponding to the graphs of FIGS. 14 and 15 may be stored in advance in the memory 60.

The above is the fourth embodiment. As mentioned above, according to the fourth embodiment, the length of the regeneration period of the PM sensor 5 can be properly set based on the exhaust gas temperature and the exhaust gas flow rate. Even if there is a variation in the exhaust gas temperature and the exhaust gas flow rate, the regeneration process can be performed with avoiding the excess burning, the unnecessarily long length of the regeneration period, and the situation where a part of PM remains after burning, etc.

The embodiments described above are not limited to the above description, and may be modified as appropriate within a scope not departing from the spirit of the invention. For example, the above elements using information of the exhaust gas temperature and the exhaust gas flow rate in the fourth embodiment may be incorporated in the second and third embodiments. If the elements are incorporated in the second embodiment, steps S16 and S17 may be added before step S30 of FIG. 5, and, at step S60, the ECU 6 may calculate the length of the period of the regeneration process of the OM sensor 5 using the above maps of FIGS. 14 and 15.

If these elements are incorporated in the third embodiment, steps S16 and S17 may be added in front of step S30 of FIG. 11, and, at step S65, the ECU 6 may correct the electrode temperature at the vertical axis of FIG. 10 in the same manner as FIGS. 14 and 15. That is, the ECU 6 may correct the electrode temperature so that, as the exhaust gas temperature becomes higher, the electrode temperature also becomes higher, and, as the exhaust gas flow rate becomes larger, the electrode temperature becomes lower in consideration of the removal of heat.

The method of calculating the exhaust gas flow rate (flow speed) in the above step S17 may be performed as follows. Specifically, in consideration of quantity of injection in a cylinder of the engine 2, a mass flow rate per unit time of the intake air measured by the air flow meter 30 is converted into a volume flow rate of the exhaust gas. For example, the volume flow rate is calculated using the following Formula (E1).

$$V(m^3/sec)=[[G(g/sec)/28.8\ (g/mol)]\times 22.4\times 10^{-3}(m^3/mol)+[Q(cc/sec)/207.3\ (g/mol)\times 0.84\ (g/cc)\times 6.75]\times 22.4\times 10^{-3}(m^3/mol)]\times[Teg(K)/273(K)]\times[P0(kPa)/[P0(kPa)+dP(kPa)]] \quad (E1)$$

In Formula (E1), "$V(m^3/sec)$" indicates a volume flow rate of the exhaust gas flowing through the exhaust pipe 4, "G(g/sec)" indicates a mass flow rate per unit time of intake air, "Teg(K)" indicates an exhaust gas temperature, "P0(kPa)" indicates an atmospheric pressure, "dP(kPa)" indicates a DPF pressure difference, and "Q(cc/sec)" indicates a fuel injection quantity per unit time. Further, "G" and "Teg" may indicate a measurement value of the air flow meter 30 and a measurement value of the exhaust gas temperature sensor 42, respectively, and "Q" may indicate an instruction value of the quantity of injection for the injector 20.

In the right-hand side of Formula (E1), the first term indicates a mass flow rate of intake air converted into a volume flow rate, and the second term indicates an increase that is a difference in the amount between the intake air and the exhaust gas after combustion of the injected fuel. In the second term, "0.84 (g/cc)" indicates a typical liquid density of light oil. The numeral "$22.4\times 10^{-3}$ ($m^3$/mol)" indicates a volume per 1 mol of an ideal gas at 0 degree centigrade and 1 atmosphere. Also, the numeral "6.75" indicates an increase rate in molar number of the exhaust gas for a fuel injection quantity of 1 mol.

The increase rate (6.75) is obtained as follows. Specifically, the composition of light oil is typically expressed by $C_{15}H_{27.3}$ (molecular weight: 207.3), and thus combustion is expressed by the following Reaction Formula (E2).

$$C_{15}H_{27.3}+21.75O_2\rightarrow 15CO_2+13.5H_2O \quad (E2)$$

Accordingly, the exhaust gas has a molar number which is 6.75 (=(15+13.5)−21.75) times larger than the fuel injection quantity of 1 mol.

Fuel is injected with injection intervals predetermined by the ECU 6 to achieve intermittent injection. The fuel injection quantity "Q" in Formula (E1) indicates an average fuel injection quantity taking into account not only the injecting period but also the non-injecting period.

The volume flow rate of the exhaust gas flowing through the exhaust pipe 4 may be calculated by the following Formula (E3).

$$V(m^3/sec)=[[G(g/sec)/28.8\ (g/mol)]\times 22.4\times 10^{-3}(m^3/mol)+[Q(cc/sec)/207.3\ (g/mol)\times 0.84\ (g/cc)\times 6.75]\times 22.4\times 10^{-3}(m^3/mol)]\times[Teg(K)/273(K)]\times[P0(kPa)/[P0(kPa)+dP(kPa)]] \quad (E3)$$

The volume flow rate calculated by Formula (E3) corresponds to the exhaust gas flow speed at the upstream of the DPF 40. In Formula (E3), "P0(kPa)" indicates an atmospheric pressure and "dP(kPa)" indicates a DPF pressure difference. For example, the DPF pressure difference may be measured by providing the differential-pressure meter 41.

The PM sensor 5 used in the above embodiments for outputting a current value may be replaced by a PM sensor that includes a shunt resistor and outputs a voltage value. Any sensor may be used, if the sensor is able to output a value correlated to the PM amount in an exhaust pipe.

In the embodiments described above, the PM sensor 5 and the insulator 50 correspond to the detection unit and the attachment element, respectively. The ECU 6, which includes the memory 60 and performs processes in steps of FIGS. 2, 5, 8, 9, 11 and 13, corresponds to the control unit, the first to eighth setting units, the calculation unit, the estimation unit, the subtraction unit, the temperature detection unit, and the flow rate detection unit.

The present invention may be embodied in several other forms without departing from the spirit thereof. The embodiments and modifications described so far are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A detection apparatus, comprising:

a sensor that is disposed in an exhaust path of an internal combustion engine through which an exhaust gas flows, includes an attachment element to which particulate matter in the exhaust gas is configured to attach, and is configured to detect a correlation value that is correlated with an amount of particulate matter which is attached to the attachment element;

a heater that is configured to heat the attachment element; and a control unit that is configured to perform a feedback control of a temperature of the attachment element so as to follow a target temperature while a regeneration process is performed to allow the heater to heat the attachment element so as to burn particulate matter which attaches to the attachment element, the control unit being configured to:

set the target temperature before a start of the regeneration process so that the target temperature becomes lower, as the correlation value, which is detected by the sensor before the start of the regeneration process, becomes larger; and set a completion timing of the regeneration process before the start of the regeneration process so that a period of the regeneration process becomes longer, as the correlation value, which is detected by the sensor before the start of the regeneration process, becomes larger.

2. The detection apparatus according to claim 1, further comprising a flow rate sensor that is configured to detect a flow rate of the exhaust gas which flows through the exhaust path, wherein the control unit is configured to set the completion timing of the regeneration process so that the period of the regeneration process becomes longer, as the flow rate of the exhaust gas detected by the flow rate sensor becomes larger.

3. An engine system, comprising:

an internal combustion engine; and a detection apparatus including:

a sensor that is disposed in an exhaust path of an internal combustion engine through which an exhaust gas flows, which includes an attachment element to which particulate matter in the exhaust gas attaches, and is configured to detect a correlation value that is correlated with an amount of particulate matter which attaches to the attachment element;

a heater that is configured to heat the attachment element; and a control unit configured to perform a feedback control of a temperature of the attachment element so as to follow a target temperature while a regeneration process is performed to allow the heater to heat the attachment element so as to burn particulate matter which attaches to the attachment element, the control unit being configured to:

set the target temperature before a start of the regeneration process so that the target temperature becomes lower, as the correlation value, which is detected by the sensor before the start of the regeneration process, becomes larger; and set a completion timing of the regeneration process before the start of the regeneration process so that a period of the regeneration process becomes longer, as the correlation value, which is detected by the sensor before the start of the regeneration process, becomes larger.

4. A detection method, comprising:

at a sensor that is disposed in an exhaust path of an internal combustion engine through which an exhaust gas flows, and which includes an attachment element to which particulate matter in the exhaust gas attaches, detecting a correlation value that is correlated with an amount of particulate matter which attaches to the attachment element;

at a heater, heating the attachment element; and at a control unit:

performing a feedback control of a temperature of the attachment element so as to follow a target temperature while a regeneration process is performed to allow the heater to heat the attachment element so as to burn particulate matter which attaches to the attachment element;

setting the target temperature before a start of the regeneration process so that the target temperature becomes lower, as the correlation value, which is detected by the sensor before the start of the regeneration process, becomes larger; and setting a completion timing of the regeneration process before the start of the regeneration process so that a period of the regeneration process becomes longer, as the correlation value, which is detected by the sensor before the start of the regeneration process, becomes larger.

5. The engine system according to claim 3, wherein the control unit is configured to:

detect a flow rate of the exhaust gas which flows through the exhaust path, and set the completion timing of the regeneration process so that the period of the regeneration process becomes longer, as the detected flow rate of the exhaust gas becomes larger.

6. The detection method according to claim 4, further comprising:

at the control unit, detecting a flow rate of the exhaust gas which flows through the exhaust path; and setting the completion timing of the regeneration process so that the period of the regeneration process becomes longer, as the detected flow rate of the exhaust gas becomes larger.

* * * * *